US007888574B1

(12) United States Patent
Acoutin

(10) Patent No.: US 7,888,574 B1
(45) Date of Patent: Feb. 15, 2011

(54) DRUM WITH KEYED INTERCHANGABLE SECTIONS

(76) Inventor: Cooper Acoutin, 16526 Campesina Ln, Huntington Beach, CA (US) 92648

( * ) Notice: Subject to any disclaimer, the term of this patent is extended or adjusted under 35 U.S.C. 154(b) by 2 days.

(21) Appl. No.: 12/575,010

(22) Filed: Oct. 7, 2009

(51) Int. Cl.
*G10D 13/02* (2006.01)

(52) U.S. Cl. ..... 84/411 R; 84/412

(58) Field of Classification Search ..... 84/411 R, 84/412

See application file for complete search history.

(56) References Cited

U.S. PATENT DOCUMENTS

| | | | | | |
|---|---|---|---|---|---|
| 578,198 | A | | 3/1897 | Boulanger | |
| 673,633 | A | | 5/1901 | Boulanger | |
| 1,420,233 | A | | 6/1922 | Baldwin et al. | |
| 1,768,438 | A | * | 6/1930 | Clark | 84/412 |
| 2,563,346 | A | * | 8/1951 | Livingston | 84/412 |
| 3,911,779 | A | * | 10/1975 | Della-Porta | 84/411 R |
| 3,985,257 | A | * | 10/1976 | Shaffer et al. | 220/669 |
| 4,060,019 | A | * | 11/1977 | Cordes | 84/411 R |
| 4,300,437 | A | * | 11/1981 | Hinger et al. | 84/411 R |
| 4,455,913 | A | * | 6/1984 | Willis | 84/412 |
| 4,869,146 | A | * | 9/1989 | Bonsor | 84/413 |
| 4,928,565 | A | * | 5/1990 | Hsieh | 84/411 R |
| 5,353,674 | A | | 10/1994 | Volpp | |
| 5,377,576 | A | * | 1/1995 | Good et al. | 84/411 R |
| 5,675,099 | A | | 10/1997 | Granatello | |
| 5,875,979 | A | * | 3/1999 | Walters et al. | 241/79.3 |
| 6,211,448 | B1 | * | 4/2001 | Shigenaga et al. | 84/411 R |
| 6,242,679 | B1 | * | 6/2001 | Carlson | 84/411 R |
| 6,365,811 | B1 | * | 4/2002 | Conta | 84/411 R |
| 6,462,262 | B2 | * | 10/2002 | Hagiwara | 84/411 R |
| 7,361,823 | B2 | * | 4/2008 | Rush | 84/411 R |
| 7,718,876 | B1 | * | 5/2010 | Good | 84/411 R |
| 7,781,659 | B2 | * | 8/2010 | Liao | 84/412 |
| 7,781,660 | B2 | * | 8/2010 | Paterson | 84/412 |
| 2006/0249005 | A1 | | 11/2006 | Rush | |
| 2009/0013850 | A1 | | 1/2009 | Abe | |
| 2009/0308225 | A1 | * | 12/2009 | Natali | 84/411 R |
| 2010/0218662 | A1 | * | 9/2010 | Case et al. | 84/415 |

* cited by examiner

*Primary Examiner*—Elvin G Enad
*Assistant Examiner*—Robert W Horn
(74) *Attorney, Agent, or Firm*—Kirk A. Buhler; Buhler & Associates

(57) ABSTRACT

Improvements in a drum is disclosed. The improvements include the ability for a single drum center hoop to accommodate different end hoops to replicate the acoustical properties of the 39 snare drums that are commonly used. The drum hoops are each constructed with a key that allows mating pieces to connect in only one specific location or orientation. The keying ensures that the snare bed is properly oriented for optimal tone and function of the drum snare. Each side is individually changeable, nestable and stackable to make larger drums or drums with different cosmetic features. The materials and material thicknesses are also alterable to change the resulting tonal characteristics of the drum. The membrane edge support is alterable of changeable without requiring the entire drum to be replaced.

20 Claims, 4 Drawing Sheets

DRAWINGS

DRUM WITH KEYED INTERCHANGABLE SECTIONS

CROSS REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in a musical instrument drum. More particularly, the present drum improvements are for a drum that is changeable to alter the internal volume that changes or alters the sound from the drum. Even more specifically the improvement is for a snare drum.

2. Description of Related Art Including Information Disclosed Under 37 CFR 1.97 and 1.98

Most drummers perform with a number of drums where each drum has a different tonal quality. Usually a drummer must purchase a number of fixed dimension drums to obtain the desired tonal quality from each individual drum. There have been several patents that have been issued that address interchangeability or modifications to a drum to change the sonic properties of a drum. Exemplary examples of patents covering these drums are disclosed herein.

U.S. Pat. No. 5,675,099 issued on Oct. 7, 1997 to Tullio Granatello and published application Number US 2006/0249005 that was published on Nov. 9, 2006 to Mark A. Rush disclose a drum where the bearing edge or the membrane support rings are changeable. Changing or altering these parts can have some minor effect on the sonic properties of the drum and changing these components is often desirable because of damage or harm from playing the drum. While the replacement of these parts may be desirable for maintenance or servicing of the drum, they provide limited ability to alter the tone of the drum.

U.S. Pat. No. 5,377,576 issued on Jan. 3, 1995 to John J. Good et al., discloses a drum constructed with metal and wood sections. The use of metal and wood section in this patent is made to impart a more desirable audible sound to the drum. While a more desirable sound may be achieved, the components can be installed in an omni-directional orientation where the addition of a snare attachment is not possible because the orientation of the shell components is not restricted to a specific location on the inner drum shell.

U.S. Pat. No. 4,300,437 issued on Nov. 17, 1981 to Fred D. Hinger et al., U.S. Pat. No. 1,420,233 issued on Jun. 20, 1922 to W. H. Baldwin et al., U.S. Pat. No. 673,633 issued on May 7, 1901 to E. Boulanger and U.S. Pat. No. 578,198 issued on Mar. 2, 1897 to E. Boulanger each disclose drums where the drum heads are movable on drum tension rods or the like.

When the drum heads are moved apart an air gap is created between the hoops of the drum. While moving the drum heads apart as disclosed in these patents will change the sonic properties to the drum the enlarged air gap that is created creates a muffling effect on the sound. The performer is also limited to the wall sections and thicknesses of the initial drum and interchangeability is not possible.

What is needed is a universal arrangement of drum shell components where one central drum tube can be used to make the 39 commonly known snare drums. The proposed application provides a solution to this problem with keyed drum sections that are all interchangeable and stackable to alter the length, wall thickness, materials and tonal characteristics of the snare drum.

BRIEF SUMMARY OF THE INVENTION

It is an object of the drum with keyed interchangeable sections for the central hoop to accommodate a variety of different thickness and length end pieces to simulate the most common 39 types of snare drums. The convertibility give a performer an ability to mix and match pieces without the expense of purchasing all 39 different drums. While there may be other variations that are used for unique sounds, these variations can also be constructed or added to the central hoop.

It is an object of the drum with keyed interchangeable sections for the connecting or joining surfaces to be coating to seal and protect from moisture as well as strengthen the mating surfaces. The coating provides also allows for a smoother mating surface and further provides for a tighter seal between drum sections. It is further contemplated that the mating surfaces are made from metal to provide a hard mating surface.

It is an object of the drum with keyed interchangeable sections to have a snare bed formed in the bottom hoop. The snare bed allows for the insertion of a snare on the bottom of the drum. The snare bed is formed in only two sides of the bottom hoop. Because the snare bed only exists in two opposed 180 degree locations the mating of the drum components must be fixed to one or both of these orientations.

It is an object of the drum with keyed interchangeable sections for the drum hoops to be identified with top and or bottom indicators to ensure that the hoops are inserted or assembled in proper orientation. The proper orientation is important to ensure that the drum has the proper tone when being struck.

It is an object of the drum with keyed interchangeable sections for multiple sections to be nestable to increase to height of the drum to change the tone or sound of the drum. The drum hoop pieces can also be made from different thicknesses, materials or colors to change not only the tone but the cosmetic appearance of the drum. For example if a performer is required to change the color(s) of the drum to match a particular performing group, they can simply change the outer drum hoops without purchasing an entirely new drum or drums.

It is still another object of the drum with keyed interchangeable sections for the membrane support edge to be replaceable or changeable without requiring replacement of the entire drum. A membrane support edge can be individually replaced or changed if damaged without requiring replacement of the entire drum.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
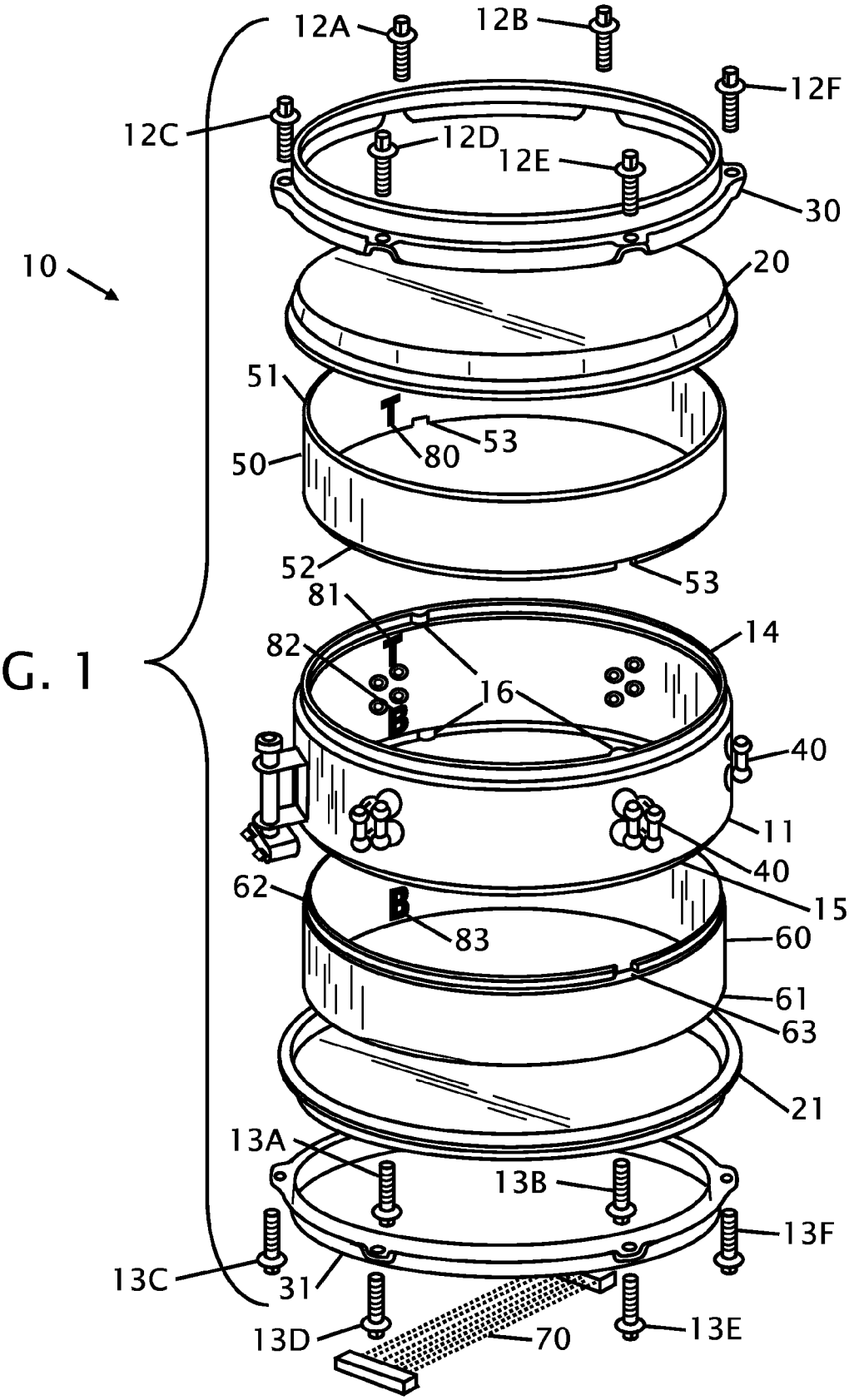
FIG. 1 shows a drum with keyed interchangeable sections.

FIG. 1 shows a drum with keyed interchangeable sections. The drum in this figure is shown in a partially exploded view to show not only the unique features of the drum but also the various components that are used in conjunction with a snare drum 10. A typical drum has one or more closures, heads or skins 20 and 21 that close one or both sides of a drum. The drum head or skins 20 and 21 are retained and tensioned onto the shell of a drum with an upper flange 30 and or lower flange 31. These flanges are held onto the central drum shell 11 with tightening adjustment fasteners 12A-12F for the top drum head 20 and tightening adjustment fasteners 13A-13F for the lower head 21. These fasteners pass through the upper 30 and lower flange and thread into threaded retainer elements 40 that are secured onto the central drum shell 11.

In the embodiment shown, the retainer elements 40 are shown with offset retainers that secure the opposing fasteners to the central hoop 11, but various different configurations of these fasteners are available and contemplated. The top drum head 20 is stretched over the upper edge 51 of an upper drum hoop 50. In the preferred embodiment, the upper edge 51 is rounded to reduce harming the top drum head 20. The bottom drum head 21 is stretched over the lower edge 61 of a lower drum hoop 60. In the preferred embodiment, the lower edge 61 is rounded and further has a recess for a snare. The edge is rounded to reduce harming the lower drum head 21. It is further contemplated that these edges can be changeable or replaceable for repair or tone characteristics.

Both the upper hoop 50 and the lower hoop 60 have stepped edges 52 and 62 respectively that engage in accommodating step edges 14 and 15 on the central drum shell 11. The stepped edges can be coating to seal and protect from moisture as well as strengthen the mating surfaces. The coating provides also allows for a smoother mating surface and further provides for a tighter seal between drum sections. It is further contemplated that the mating surfaces are made from metal to provide a hard mating surface.

An arced key area 16 exists in the step on both sides of the central drum shell 11. A corresponding arced void(s) 53 exists on the upper hoop and a corresponding arced void 63 exists on the lower hoop 63. These arced keys ensure that the drum pieces engage in only one specific rotation on the drum pieces. This is a critical limitation because it ensures that the snare will be properly aligned with the snare tensioning hardware for proper operation of the snare 70.

Orientation and locating indicia 80-83 identify the order and rotational arrangement for the drum pieces. The upper hoop 50 and the lower hoop 60 have different edges and therefore the hoops must be properly stacked. It is also contemplated that the locating keys in the upper and lower hoops can be different to further limit mis-assembly of the drum hoops.

Figure 2:
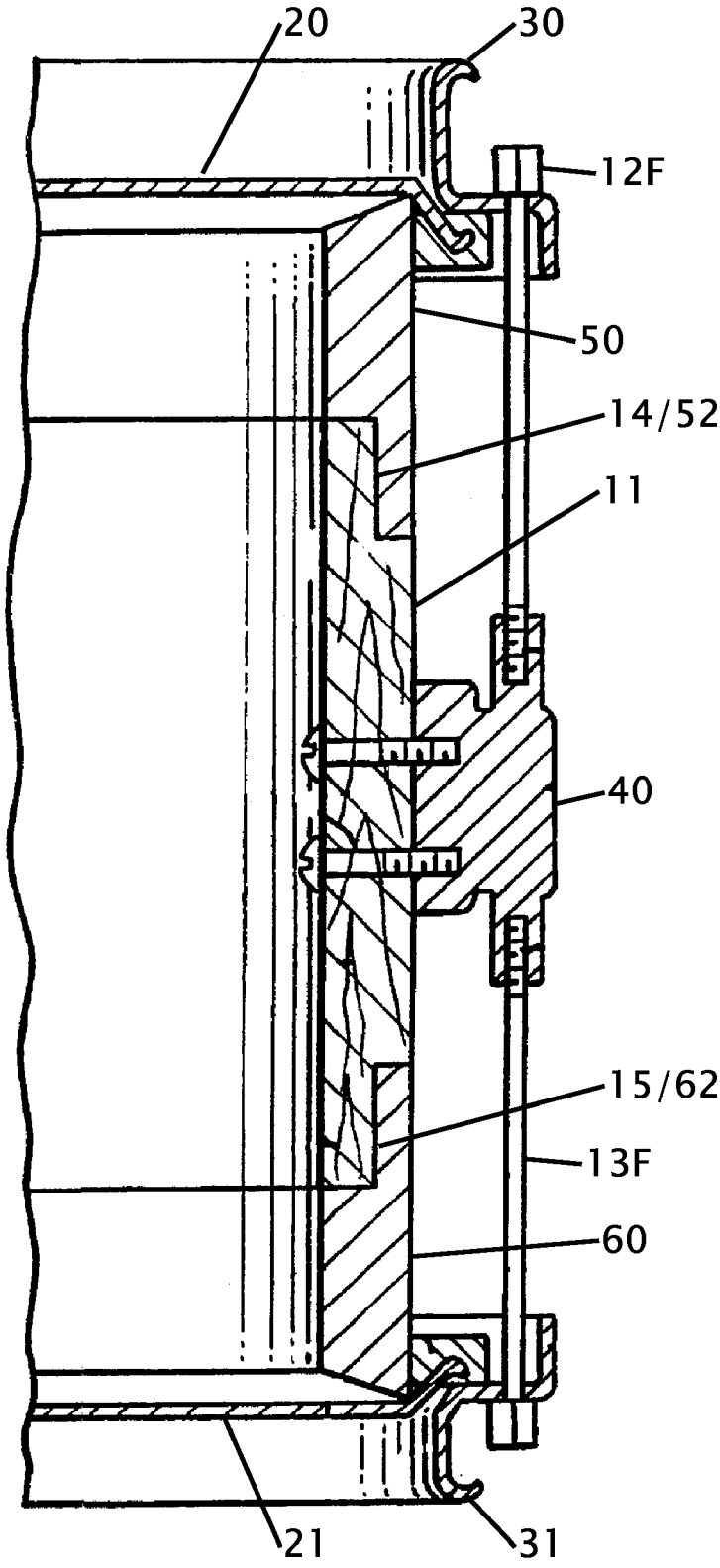
FIG. 2 shows a cross sectional view of the assembled drum.

FIG. 2 shows a cross sectional view of the assembled drum. Most drum hoops are constructed from laminated wood and in particular maple or other hardwoods. The diameter and height of the drum hoop changes the interior volume of the drum and thereby changes the sound from the drum. While wood is the preferred material other materials are contemplated and include but are not limited to plastics, metals, glass, vegetables and animal parts. This sectional view show the central drum shell 11 with the retaining elements 40 secured into the central drum shell 11. The upper hoop 50 is shown engaged in the corresponding stepped edge of the central drum shell 11 and the lower hoop 60 is shown engaged in the corresponding stepped edge of the central drum shell 11. The upper and lower drum heads 20 cover the ends of the upper hoop 50 and the lower hoop 60. The drum heads 20 are further shown being pulled onto the central drum shell 11 with the upper flange 30, and the lower flange 31 with the tightening adjustment fasteners that are engaged in the retaining elements 40.

Figure 3:
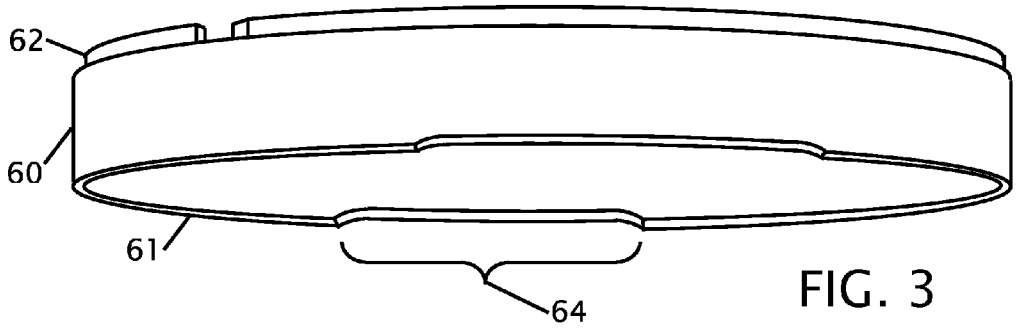
FIG. 3 shows a perspective view of the snare recess.

FIG. 3 shows a perspective view of the snare recess. The snare recess 64 is only located on the lower hoop 60. The snare recess 64 is a slight rising of the lower edge 61 of the lower hoop 60. The rise is rounded to allow for a smooth transition of the drum head (not shown). The snare recess also exists on both opposing sides of the lower edge 61. The snare recess 64 allows a snare attachment to sit in closer proximity to the drum head.

Figure 4:
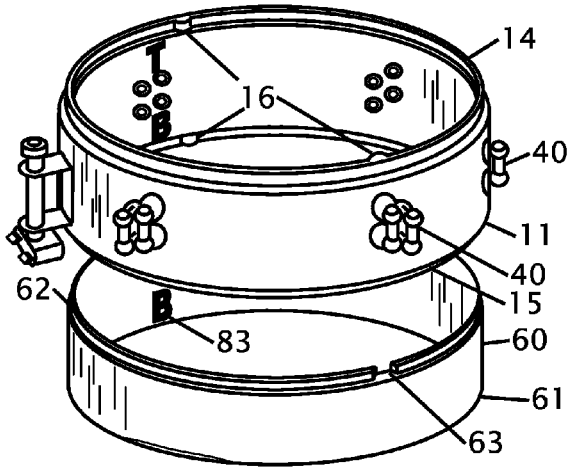
FIG. 4 shows a perspective view of a first preferred embodiment of an arced locating tab and recess.

FIG. 4 shows a perspective view of a first preferred embodiment of an arced locating tab 16 and recess 63. This embodiment is the preferred configuration and is preferably placed in two locations that are 180 degrees opposed. The arc shape allows for guiding the mating parts and also for a tight connection. The arc shape is also less susceptible to damage and further is fairly easy to manufacture in a routing or turning fabrication method. While the arc is shown in two 180 degree opposed locations in some views, it is contemplated to use as few as one to many more than two locations. The preferred embodiment uses two 180 degree opposed locations because the 180 degree arrangement allows for use with a snare attachment having only two 180 degree opposed connection locations on the drum.

Figure 5:
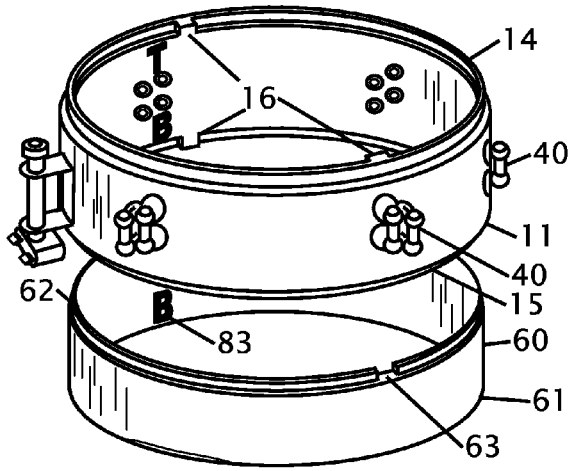
FIG. 5 shows a perspective view of a second preferred embodiment of a polygonal locating tab and recess.

FIG. 5 shows a perspective view of a second preferred embodiment of a polygonal locating tab 16 and recess 63. This embodiment is shown to identify other equivalent configurations. While a trapezoidal shape is shown and described other shapes are contemplated including but not limited to triangular toothed, square, rectangular, notched and others. The actual shape is not critical as long as it allows the drum parts to connect in only the desired orientation.

Figure 6:
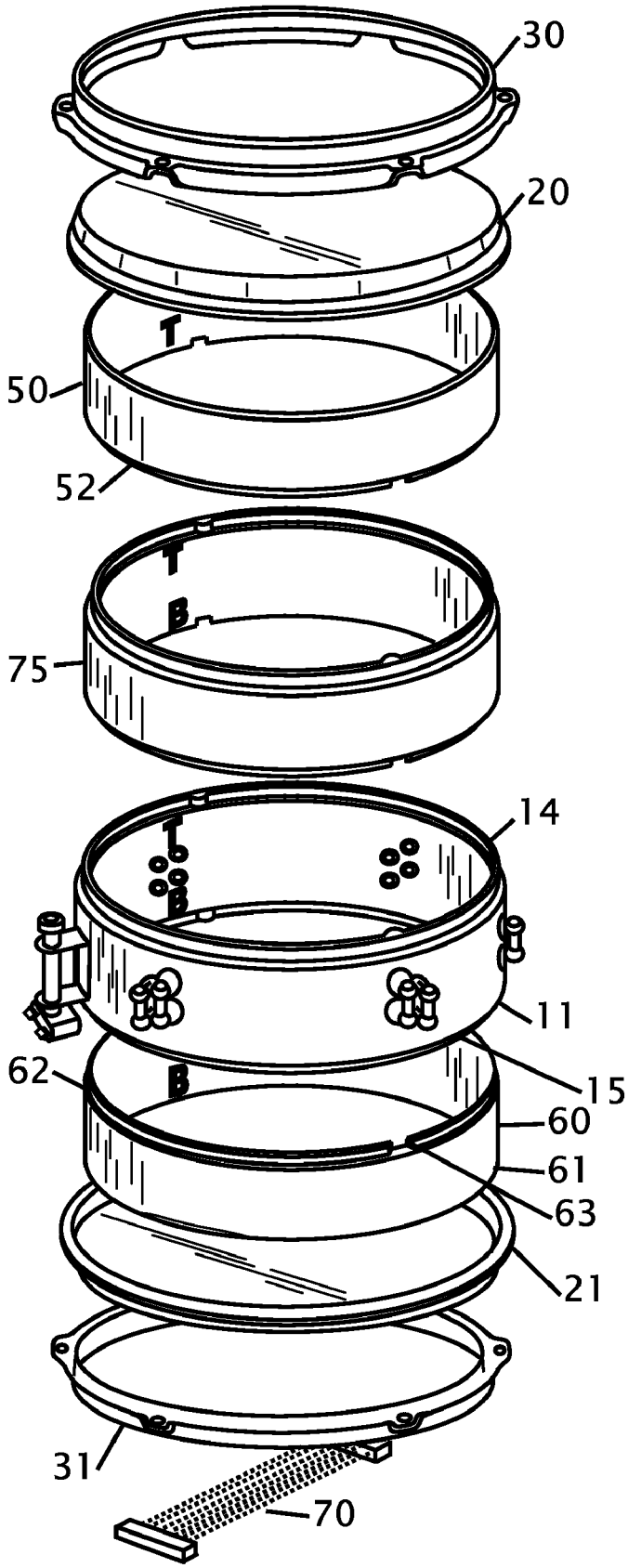
FIG. 6 shows a perspective view of a stacked set of drum shells.

FIG. 6 shows a perspective view of a stacked set of drum shells. In the preferred embodiment only one upper hoop 50 and one lower hoop 60 is used with a central drum shell 11. The embodiment shown is a contemplated arrangement where one or more extension hoops are stacked onto a central drum shell 11 with an upper hoop 50 and a lower hoop 60 connected with one or more extension hoops 75 to create a drum with larger internal volume and height. It should be understood that the extension hoop 75 is configured to mate not only with central 11, upper 50 and lower 60 hoops, but also with other extension hoops 75. The upper, central, extension and or lower hoops can be made or built-up from different thicknesses of material to further provide another option for tonal characteristics. It is also contemplated that these hoop sections can be created with different venting openings to give yet another option for tonal adjustment.

Thus, specific embodiments of a drum with keyed interchangeable sections have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A drum with keyed interchangeable sections comprising:

a central drum hoop;

said central drum hoop having outer edges wherein each outer edge has an elevated lip with a key feature that disrupts said lip;

at least two outer drum hoops wherein one outer drum hoop is an upper hoop and one is a lower hoop;

said at least two outer drum hoops having an inner edge with an elevated lip with a key feature that engages in said central drum hoop outer edge key feature;

said at least two outer drum hoops further having an outer edge that is configured for support of a drum head or drum membrane;

said central drum hoop having attachment hardware for securing drum tension rods, and at least one drum head or drum skin that covers at least one of said outer edges on said outer drum hoops.

2. The drum with keyed interchangeable sections according to claim 1 wherein said key exists on only one location on said lip.

3. The drum with keyed interchangeable sections according to claim 1 wherein said there are two said keys that exists on 180 degrees opposed sides.

4. The drum with keyed interchangeable sections according to claim 1 wherein said keys exist at equally spaced intervals on said edge.

5. The drum with keyed interchangeable sections according to claim 1 wherein said key is arc shapes.

6. The drum with keyed interchangeable sections according to claim 1 wherein said key is polygonal shaped.

7. The drum with keyed interchangeable sections according to claim 1 wherein said lower drum hoop has at least two snare bed recesses.

8. The drum with keyed interchangeable sections according to claim 1 wherein said central hoop, upper hoop and lower hoop are marked to indicate top and bottom.

9. The drum with keyed interchangeable sections according to claim 1 wherein multiple hoop said upper hoop and or said lower hoop can be stacked to increase an overall height of said drum.

10. The drum with keyed interchangeable sections according to claim 1 wherein material of said drum is made from at least one of wood, glass, plastic or metal.

11. The drum with keyed interchangeable sections according to claim 1 wherein said lip is further coated.

12. The drum with keyed interchangeable sections according to claim 1 wherein said lip is further covered with a metallic surface.

13. The drum with keyed interchangeable sections according to claim 1 wherein said upper hoop and or lower hoop are constructed with thicker or thinner material in comparison to a thickness of said middle hoop.

14. The drum with keyed interchangeable sections according to claim 1 wherein said upper hoop and or lower hoop further include a changeable membrane support edge.

15. The drum with keyed interchangeable sections according to claim 1 wherein said central hoop, upper hoop and lower hoop are cosmetically the same color or pattern.

16. The drum with keyed interchangeable sections according to claim 1 wherein said central hoop, upper hoop and lower hoop are cosmetically different colors or patters.

17. The drum with keyed interchangeable sections according to claim 1 wherein said drum further has hardware for attaching a snare.

18. The drum with keyed interchangeable sections according to claim 1 wherein said drum hoops are interchangeable to make more than one drum with different acoustic properties.

19. The drum with keyed interchangeable sections according to claim 1 wherein said drum hoops are interchangeable to make at least 39 different snare drums.

20. The drum with keyed interchangeable sections according to claim 1 wherein said drum central hoop, upper hoop and lower hoop when nested with drum head closures and a snare create a sealed snare drum.

* * * * *